US005609224A

United States Patent [19]

Baggot

[11] Patent Number: 5,609,224

[45] Date of Patent: Mar. 11, 1997

[54] ELEVATOR DOOR SILL

[75] Inventor: Breffni X. Baggot, Storrs, Conn.

[73] Assignee: Otis Elevator Company, Farmington, Conn.

[21] Appl. No.: 455,299

[22] Filed: May 31, 1995

[51] Int. Cl.[6] ..... B66B 13/02

[52] U.S. Cl. ..... 187/313; 187/414

[58] Field of Search ..... 187/313, 334, 187/325, 400, 391, 414

[56] References Cited

FOREIGN PATENT DOCUMENTS 4813918 4/1973 Japan .
2052894 2/1990 Japan ..... 187/414

*Primary Examiner*—Kenneth Noland

[57] ABSTRACT

An elevator cab (10) with a door sill (28) adjacent to the landing sill (40) with a gap (44) therebetween and the door sill and/or landing sill configured to produce a visual effect of enlarging the visual appearance of the gap.

18 Claims, 1 Drawing Sheet

FIG. 1
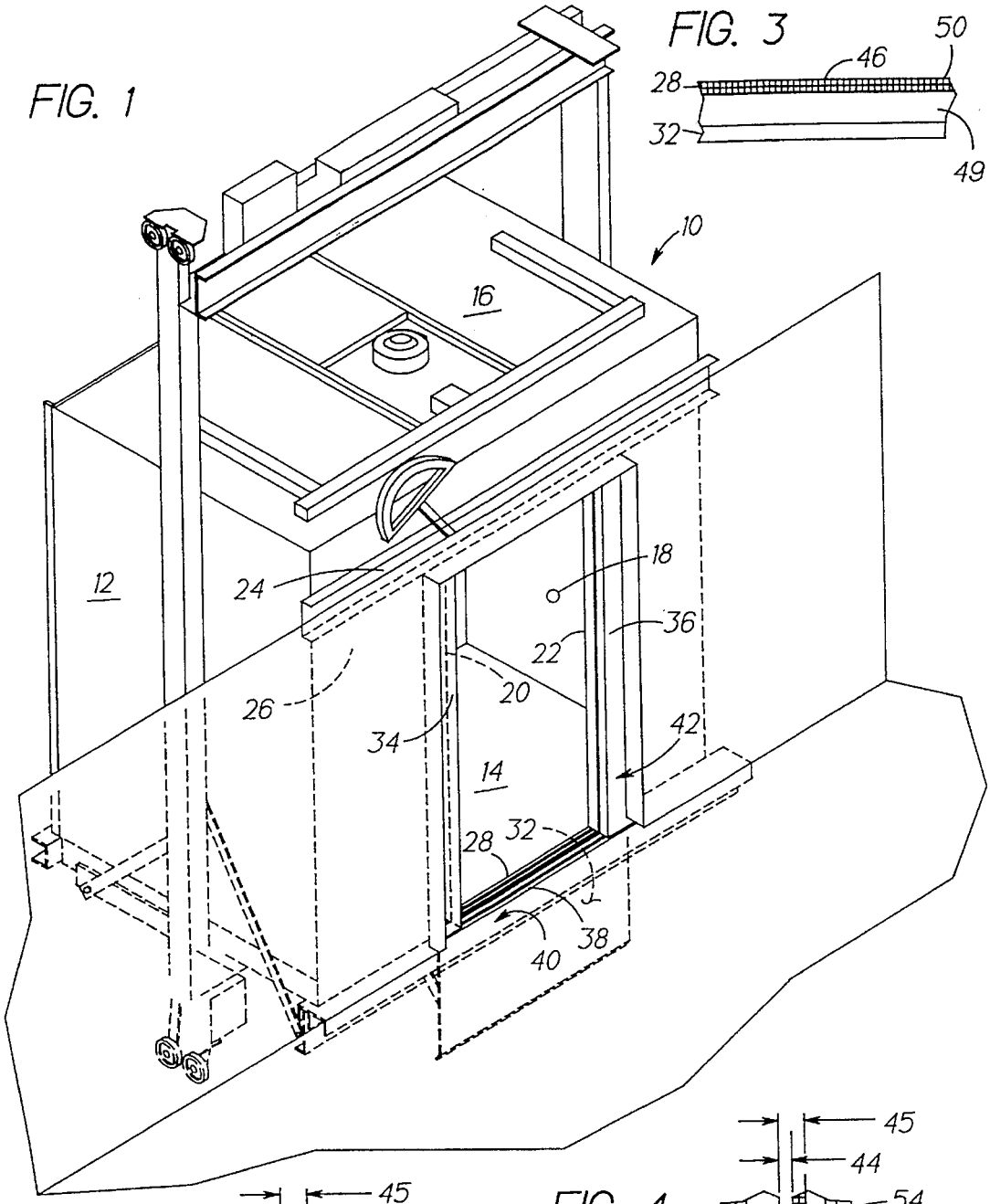
FIG. 3
FIG. 2
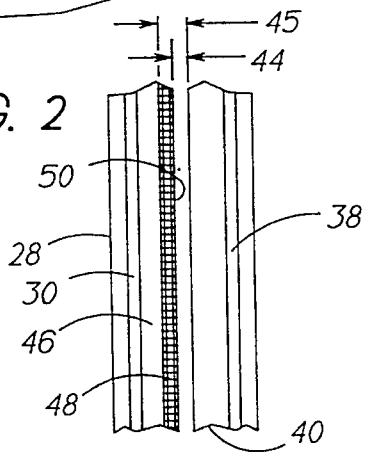
FIG. 4
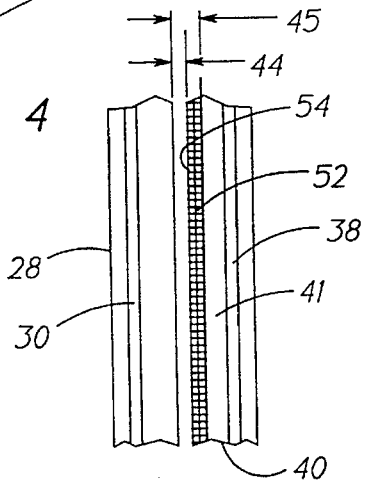

ELEVATOR DOOR SILL

TECHNICAL FIELD

This invention relates to elevator doorways and more particularly to the door sill assemblies of an elevator cab and hoistway landing.

BACKGROUND OF THE INVENTION

A conventional elevator cab has an entrance protected by single or double doors. The doors ride on tracks attached to the cab facia and in a door sill at the bottom of the cab. A gib attached to the bottom of each door engages a guide track in the door sill. Similarly, each landing has hoistway doors which ride on door tracks mounted to a header in the hoistway and in a landing sill. The hoistway doors are mechanically coupled to the car doors when the car is at a landing so that the car doors and hoistway doors are opened and closed in unison by a door operator usually mounted on top of the car.

When a cab is at a landing with the cab doors and hoistway doors open for ingress and egress, the door sill is adjacent the landing sill with a gap therebetween of approximately one-half inch (minimum) to one and one-half inch (maximum) as required by the elevator safety code and the door sill is approximately level with the landing sill within a one-half inch range as required by the American Disabilities Act. The gap between the door sill and the landing sill can be a cause of tripping incidents when entering or leaving the elevator cab, especially when the sills are not level. It is of course desirable to reduce or minimize the occurrence of tripping incidents.

DISCLOSURE OF THE INVENTION

It is an object of the present invention to provide a new and improved door sill for an elevator cab and/or hoistway landing.

Another object of the invention is to provide such a door sill which reduces the occurrence of tripping incidents during ingress and egress of the elevator cab.

A further object of the invention is to provide such a door sill which is cost efficient to manufacture.

Other objects will be in part obvious and in part pointed out more in detail hereinafter.

Accordingly, it has been found that the foregoing and related objects are attained in an elevator cab assembly having walls forming an enclosure with a door opening and a door sill extending along the door opening. The sill is adapted for positioning adjacent a landing sill forming a gap between the door sill and the landing sill when the elevator cab is positioned at the landing. The door sill has a first outer surface and the landing sill has a second outer surface and one of said first and second outer surfaces has a predetermined portion configured to produce a visual effect of enlarging the visual appearance of the gap between the door sill and the landing sill.

BRIEF DESCRIPTION OF THE DRAWINGS

FIG. 1 is a broken-away perspective view of the exterior of an elevator cab positioned at a landing;

FIG. 2 is a broken-away plan view of the door sill and landing sill of FIG. 1.

FIG. 3 is a broken-away side view along the lines 3—3 of FIG. 2.

FIG. 4 is a view similar to FIG. 2 of an alternate embodiment.

BEST MODE FOR CARRYING OUT THE INVENTION

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, the elevator cab 10 as shown in a hoistway generally comprises walls 12, floor 14, top 16 and door opening 18. The two cab doors 20, 22 (shown partly open) ride on tracks 24 attached to the cab facia 26 at the top of the door opening and in a door sill 28 at the bottom. The door sill 28 extends along the bottom of the cab and has a track 30 for receiving a gib (not shown) attached to the bottom of each door. The door sill is silver-gray in color except as described hereinafter. A toe guard 32 extends downwardly from the door sill 28.

The hoistway doors 34, 36 (shown partly open) each have door hangers (not shown) at the top of the door. Each hanger has a pair of rollers (not shown) that ride on the door track of the header (not shown) secured to the hoistway. The hoistway doors 34, 36 have gibs (not shown) which are positioned in a track 38 in the landing sill or threshold 40. The landing sill 40 extends along the landing opening 42.

Referring to FIGS. 2 and 3, when the elevator cab 10 is at a landing, the door sill 28 is directly adjacent the landing sill 40 with a gap 44 therebetween. The door sill 28 has an outer surface 47 with a stripe 48 at its outer edge 50 configured to produce a visual effect of enlarging the distance, i.e., the width, of the actual gap between the sills 28, 40. The outer surface 47 comprises upper surface 46 and side surface 49 adjoining at edge 50 and the stripe 48 is positioned on both upper surface 46 (FIG. 2) and side surface 49 (FIG. 3) along edge 50.

In the illustrated embodiment, the stripe 48 is colored black as the color black is believed to simulate the appearance of the actual gap in most elevator configurations. However, the particular color of the stripe may vary depending upon the elevator configuration and other colors, such as charcoal gray, may be more appropriate to simulate the actual gap. The stripe 48 is achieved by painting the stripe on surfaces 46, 49 along the edge 50 of the door sill. Painting is a cost-effective means of coloring a stripe and does not appreciably raise the upper surface of the sill. Other methods of providing the stripe may be utilized such as an insert of appropriately colored material formed in the outer surface of the door sill.

The illustrated configuration produces a visual effect or illusion that the width of the actual gap is greater than its actual dimension (i.e., the "apparent gap" is larger than the actual gap) so as to cause passengers to take a bigger step over the actual gap between the cab floor and the landing. When a person takes a step, his/her foot travels first in an upper arc and any stubbing that occurs will be on the door sill or landing sill. The toe stubs on the sill when it is traveling through this arc from the lowest point of the stride. By increasing the "apparent" width of the actual gap (by configuring the outer portion of the sill to produce the visual effect of a wider gap 45), a passenger will take a larger step than would be taken without the visual effect of the present invention in order to get over the larger apparent gap 45.

Such a larger step will cause the passenger to clear the actual gap and thereby reduce the possibility of tripping. Accordingly, tripping incidents will be reduced.

Preferably, the portion of stripe 28 on upper surface 46 should be sufficiently narrow to cause passengers to subconsciously perceive a larger apparent gap, but not so large that passengers would become consciously aware of the apparent gap. Consequently, the stripe is appropriately dimensioned and colored to produce a subconscious perception of a larger apparent gap.

Referring to the alternate embodiment of FIG. 4, the landing sill may be similarly configured as the door sill to produce the desired visual effect of a wider apparent gap. Similar to sill 28, the landing sill 40 has an upper surface 41 and a side surface (not shown) with a stripe 52 thereon along the edge 54 configured to produce a visual effect of enlarging the distance, i.e., the width, of the actual gap between the sills 28, 40.

Furthermore, the door sill and landing sill may both be provided with cooperating configurations that interact with the actual gap to produce the desired visual effect. For example, door sill 28 may have a stripe and landing sill 40 may have a stripe.

Other configurations to produce a visual effect which enhances the perceived width of the actual gap may be utilized. The particular configuration, including size, shape and color, of the edge portion of the sill(s) may be varied as determined by empirical methods relative to the specific elevator and landing configuration.

As can be seen, an elevator with an improved door sill and/or landing sill has been described which will reduce tripping incidents and resulting injuries at minimal additional cost to the manufacture of the sill.

As will be apparent to persons skilled in the art, various modifications and adaptations of the structure above described will become readily apparent without departure from the spirit and scope of the invention, the scope of which is defined in the appended claims.

What is claimed is:

1. An elevator cab adapted for assembly in an elevator system of a structure having a hoistway and a plurality of elevator landings along the hoistway with each landing having a landing sill, the elevator cab comprising:

walls forming an enclosure with a door opening, a door sill extending along said door opening and adapted for positioning adjacent a landing sill with a gap between said door sill and the landing sill when the cab is positioned at a landing, and said door sill having an outer surface comprising a predetermined portion configured to produce a visual effect of enlarging the visual appearance of said gap.

2. The device of claim 1 wherein said outer surface of said door sill is a first color and has an outer edge and said predetermined portion of said outer surface comprises a stripe along said outer edge of a second color predetermined to produce a visual effect of enlarging the visual appearance of said gap.

3. The device of claim 2 wherein said stripe is black.

4. The device of claim 1 wherein said outer surface of said door sill has an outer edge and said predetermined portion of said outer surface comprises a stripe along said outer edge dimensioned and colored to produce a visual effect of enlarging the visual appearance of said gap.

5. The device of claim 1 wherein said predetermined portion of said outer surface of said door sill is a predetermined color to produce a visual effect of enlarging the visual appearance of said gap.

6. An elevator system comprising:

a hoistway having at least one landing along the hoistway and said landing having a landing sill, an elevator cab mounted for movement within the hoistway to and from said landing, said cab having walls forming an enclosure with a door opening and a door sill extending along said door opening, said door sill being adjacent said landing sill with a gap therebetween when said cab is at said landing, said door sill having a first outer surface and said landing sill having a second outer surface, and one of said first and second outer surfaces having a predetermined portion configured to produce a visual effect of enlarging the visual appearance of said gap.

7. The system of claim 6 wherein said one of said first and second outer surfaces is said outer surface of said door sill.

8. The system of claim 7 wherein said outer surface of said door sill is a first color and has an outer edge and said predetermined portion of said outer surface comprises a stripe along said outer edge of a second color predetermined to produce a visual effect of enlarging the visual appearance of said gap.

9. The system of claim 8 wherein said stripe is black.

10. The system of claim 7 wherein said outer surface of said door sill has an outer edge and said predetermined portion of said outer surface comprises a stripe along said outer edge dimensioned and colored to produce a visual effect of enlarging the visual appearance of said gap.

11. The system of claim 7 wherein said predetermined portion of said outer surface of said door sill is a predetermined color to produce a visual effect of enlarging the visual appearance of said gap.

12. The system of claim 6 wherein said one of said first and second outer surfaces is said outer surface of said landing sill.

13. The system of claim 12 wherein said outer surface of said landing sill is a first color and has an outer edge and said predetermined portion of said outer surface comprises a stripe along said outer edge of a second color predetermined to produce a visual effect of enlarging the visual appearance of said gap.

14. The system of claim 13 wherein said stripe is black.

15. The system of claim 12 wherein said outer surface of said landing sill has an outer edge and said predetermined portion of said outer surface comprises a stripe along said outer edge dimensioned and colored to produce a visual effect of enlarging the visual appearance of said gap.

16. The system of claim 12 wherein said predetermined portion of said outer surface of said landing sill is a predetermined color to produce a visual effect of enlarging the visual appearance of said gap.

17. The system of claim 6 wherein the other of said first and second outer surfaces has a predetermined portion configured to produce a visual effect of enlarging the visual appearance of said gap.

18. The system of claim 17 wherein said predetermined portion of said first outer surface is a first color and said predetermined portion of said second outer surface is a second color, and said first and second colors are predetermined to produce a visual effect of enlarging the visual appearance of said gap.

* * * * *